US007142161B2

(12) United States Patent
Smith et al.

(10) Patent No.: US 7,142,161 B2
(45) Date of Patent: Nov. 28, 2006

(54) SLOT ANTENNA FOR A NETWORK CARD

(75) Inventors: James P. Smith, Mesa, AZ (US); Pedro A. Gutierrez, San Diego, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/883,355

(22) Filed: Jun. 30, 2004

(65) Prior Publication Data

US 2006/0001577 A1 Jan. 5, 2006

(51) Int. Cl.
*H01Q 1/24* (2006.01)
*H01Q 13/10* (2006.01)

(52) U.S. Cl. ..... 343/702; 343/767

(58) Field of Classification Search ..... 343/702, 343/880, 882, 767, 768, 769, 781 R, 782
See application file for complete search history.

(56) References Cited

U.S. PATENT DOCUMENTS

| | | | | |
|---|---|---|---|---|
| 5,461,392 | A * | 10/1995 | Mott et al. | 343/725 |
| 5,742,257 | A * | 4/1998 | Hadden et al. | 343/767 |
| 2003/0174095 | A1* | 9/2003 | Sievenpiper | 343/770 |
| 2004/0222923 | A1* | 11/2004 | Erkocevic | 343/700 MS |
| 2005/0035909 | A1* | 2/2005 | Lin | 343/700 MS |

* cited by examiner

*Primary Examiner*—Shih-Chao Chen
*Assistant Examiner*—Minh Dieua
(74) *Attorney, Agent, or Firm*—Kacvinsky LLC

(57) ABSTRACT

Techniques to integrate a slot antenna with a wireless network card for use with a wireless communication network.

24 Claims, 5 Drawing Sheets

500

SLOT ANTENNA FOR A NETWORK CARD

BACKGROUND

Wireless networks are becoming increasingly prevalent due to the convenience provided to a user. For example, a physical location such as a home or office may include a number of computers, such as a personal computer, laptop computer, handheld computer, and so forth. Such devices are traditionally connected to a network using wired communications media, such as twisted-pair wire or co-axial cable. Wireless networks, however, are currently available that eliminate the need for such wired communications media. An example of a wireless network may comprise an 802.11 network as defined by the Institute of Electrical and Electronics Engineers (IEEE). To arrange a computer for operation with a wireless network, however, may require the use of an antenna. The antenna is typically separate from the PC, thereby introducing additional cables, connectors and space requirements. Consequently, there may be a need for improvements in antenna design for a wireless network.

DESCRIPTION OF SPECIFIC EMBODIMENTS

Figure 1:
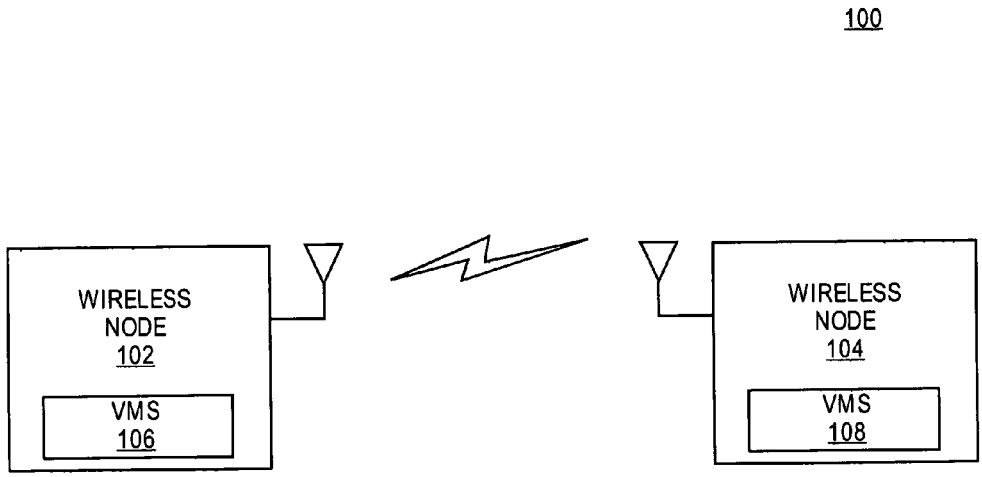
FIG. 1 illustrates a block diagram of a system in accordance with one embodiment.

FIG. 1 illustrates a block diagram of a system 100. System 100 may comprise, for example, a communication system to communicate information between multiple nodes. The nodes may comprise any physical or logical entity having a unique address in system 100. The unique address may comprise, for example, a network address such as an Internet Protocol (IP) address, device address such as a Media Access Control (MAC) address, and so forth. The embodiments are not limited in this context.

The nodes may be connected by one or more types of communications media. The communications media may comprise any media capable of carrying information signals, such as metal leads, semiconductor material, twisted-pair wire, co-axial cable, fiber optics, radio frequency (RF) spectrum, and so forth. The connection may comprise, for example, a physical connection or logical connection.

The nodes may be connected to the communications media by one or more input/output (I/O) adapters. The I/O adapters may be configured to operate with any suitable technique for controlling communication signals between computer or network devices using a desired set of communications protocols, services and operating procedures. The I/O adapter may also include the appropriate physical connectors to connect the I/O adapter with a given communications medium. Examples of suitable 1/O adapters may include a network interface card (NIC), radio/air interface, and so forth.

The general architecture of system 100 may be implemented as a wireless communication system. When implemented as a wireless system, one or more nodes shown in system 100 may further comprise additional components and interfaces suitable for communicating information signals over the designated RF spectrum. For example, a node of system 100 may include an omni-directional antenna, a wireless RF radio or transmitter/receiver ("transceiver"), control logic, and so forth. The embodiments are not limited in this context.

The nodes of system 100 may be configured to communicate different types of information, such as media information and control information. Media information may refer to any data representing content meant for a user, such as voice information, video information, audio information, text information, alphanumeric symbols, graphics, images, and so forth. Control information may refer to any data representing commands, instructions or control words meant for an automated system. For example, control information may be used to route media information through a system, or instruct a node to process the media information in a predetermined manner.

The nodes may communicate the media and control information in accordance with one or more protocols. A protocol may comprise a set of predefined rules or instructions to control how the nodes communicate information between each other. The protocol may be defined by one or more protocol standards, such as the standards promulgated by the Internet Engineering Task Force (IETF), International Telecommunications Union (ITU), IEEE, a company such as Intel® Corporation, and so forth. An example of a protocol suitable for use with system 100 may include a protocol from the IEEE 802.11 family of protocols. The embodiments, however, are not limited in this context.

Referring again to FIG. 1, system 100 may comprise a node 102 and a node 104. In one embodiment, for example, nodes 102 and 104 may comprise wireless nodes arranged to communicate information over a wireless communication medium, such as RF spectrum. Wireless nodes 102 and 104 may represent a number of different wireless devices, such as mobile or cellular telephone, a computer equipped with a wireless access card or modem, a handheld client device such as a wireless personal digital assistant (PDA), a wireless access point (WAP), a base station, a mobile subscriber center, a radio network controller, and so forth. In one embodiment, for example, node 102 may represent a computer such as a PC, laptop computer, handheld computer, and so forth. Node 104 may represent a wireless access point (WAP). Both nodes 102 and 104 may be arranged to communicate media information and control information in accordance with an 802.11 protocol. Node 104 may be further connected to a high-speed network via a DSL modem, cable modem, optional router, and so forth. Although FIG. 1 shows a limited number of nodes, it can be appreciated that any number of nodes may be used in system 100.

In one embodiment, wireless nodes 102 and 104 may each include a processing system having a processor and memory. For example, wireless node 102 may include a processor 106 and memory 110, and wireless node 104 may include a processor 108 and memory 112. Examples for processors 106 and 108 may include a general-purpose processor such as made by Intel (Corporation, or a dedicated processor such as a digital signal processor (DSP), network processor, embedded processor, micro-controller, controller and so forth. Examples for memory 110 and 112 may include any machine-readable media, such as read-only memory (ROM), random-access memory (RAM), synchronous RAM (SRAM), dynamic RAM (DRAM), synchronous DRAM (SDRAM), flash memory, magnetic disk (e.g., floppy disk and hard drive), optical disk (e.g., CD-ROM), and so forth. The embodiments are not limited in this context.

In one embodiment, node 102 may need a wireless network card to operate with an 802.11 network. As discussed previously, node 102 may comprise a desktop PC, for example. A desktop PC may be arranged with multiple expansion slots connected by an I/O bus. Each expansion slot may be arranged to receive a network card having suitable physical and electrical interfaces to communicate with the rest of node 102, such as processor 106 and memory 110. In one embodiment, for example, the expansion slots and network card may both conform to the Peripheral Component Interface (PCI) family of standards as defined by the PCI Special Interest Group (SIG), such as the PCI SIG Specification Version 3.0, dated Apr. 19, 2004 (collectively referred to as the "PCI Specification"). One problem associated with conventional wireless network cards, however, is that they typically use an external antenna. The external antenna may comprise a device separate from, and external to, the housing or chassis for node 102. This may introduce the need for additional cables, connectors and space requirements. By way of contrast, node 102 may be configured with a wireless network card with an integrated slot antenna. The use of an integrated slot antenna may reduce or eliminate the need for additional cables and connectors, and may also eliminate the additional space consumed by any external antenna. A wireless network card with integrated slot antenna may be described in more detail with reference to FIGS. 2–5.

Figure 2:
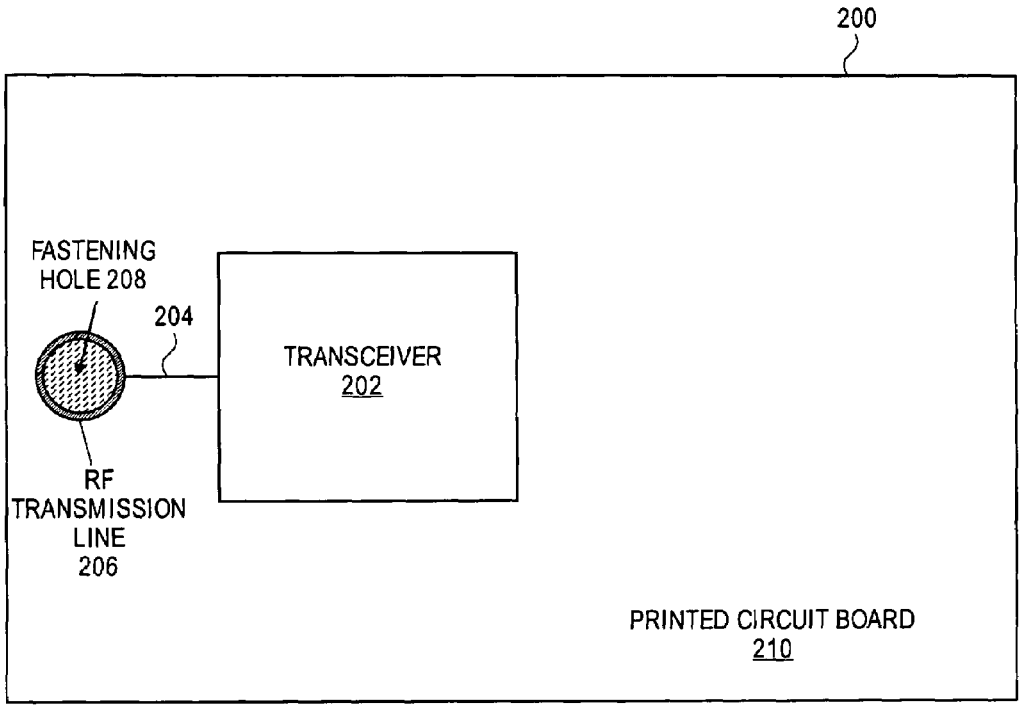
FIG. 2 illustrates a diagram of a wireless network card in accordance with one embodiment.

FIG. 2 illustrates a diagram of a wireless network card 200. Wireless network card 200 may comprise a radio such as transceiver 202 connected to an RF transmission line 206 via a trace 204. Transceiver 202 may be integrated with a printed circuit board (PCB) 210, or may comprise a separate device attached to PCB 210. RF transmission line 206 may comprise, for example, a microstrip transmission line operating at 50 Ohms. In one embodiment, RF transmission line 206 may be arranged to encircle a fastening hole 208. Fastening hole 208 may be used to attach an antenna probe to PCB 210 using a fastening device, such as a screw, nail, rivet, and so forth. An antenna probe suitable for use with wireless network card 200 may be described with reference to FIGS. 3A and 3B.

Figure 3A:
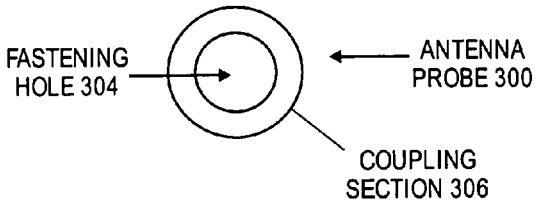
FIG. 3A illustrates a top and bottom view for an antenna probe in accordance with one embodiment.

FIG. 3A illustrates a top and bottom view for an antenna probe 300. Antenna probe 300 may comprise an antenna probe to attach to PCB 210. As shown in FIG. 3A, antenna probe 300 may have a shape of a hollow cylinder. Antenna probe 300 may include a fastening hole 304 to correspond in size and shape to fastening hole 208 of PCB 210. The bottom surface of antenna probe 300 may comprise a coupling section 306 to correspond in size and shape to RF transmission line 206. Coupling section 306 should be in substantial contact with RF transmission line 206 when antenna probe 300 is mounted to PCB 210 to facilitate coupling of energy communicated by transceiver 202 through RF transmission line 206 via trace 204.

Figure 3B:
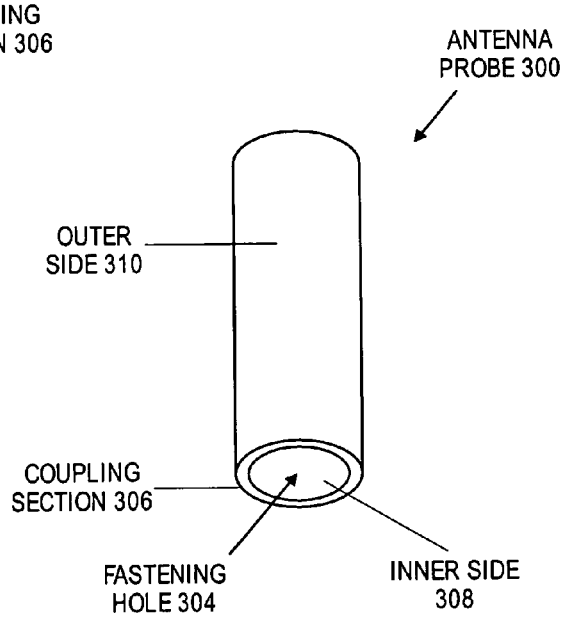
FIG. 3B illustrates a perspective view for antenna probe in accordance with one embodiment.

FIG. 3B illustrates a perspective view for antenna probe 300. As shown in FIG. 3B, fastening hole 304 of antenna probe 300 may further comprise an inner side 308 and an outer side 310. Fastening hole 304 may be arranged to operate with a fastening device as described with reference to FIG. 2. For example, inner side 308 of fastening hole 304 may have threads for a screw to securely fasten antenna probe 300 with PCB 210. The embodiments are not limited in this context.

In one embodiment, wireless network card 200 and antenna probe 300 may be combined with a director structure to form a wireless network card with an integrated slot antenna. A director structure may be described in more detail with reference to FIGS. 4A–C.

Figures 4A, 4B, 4C:
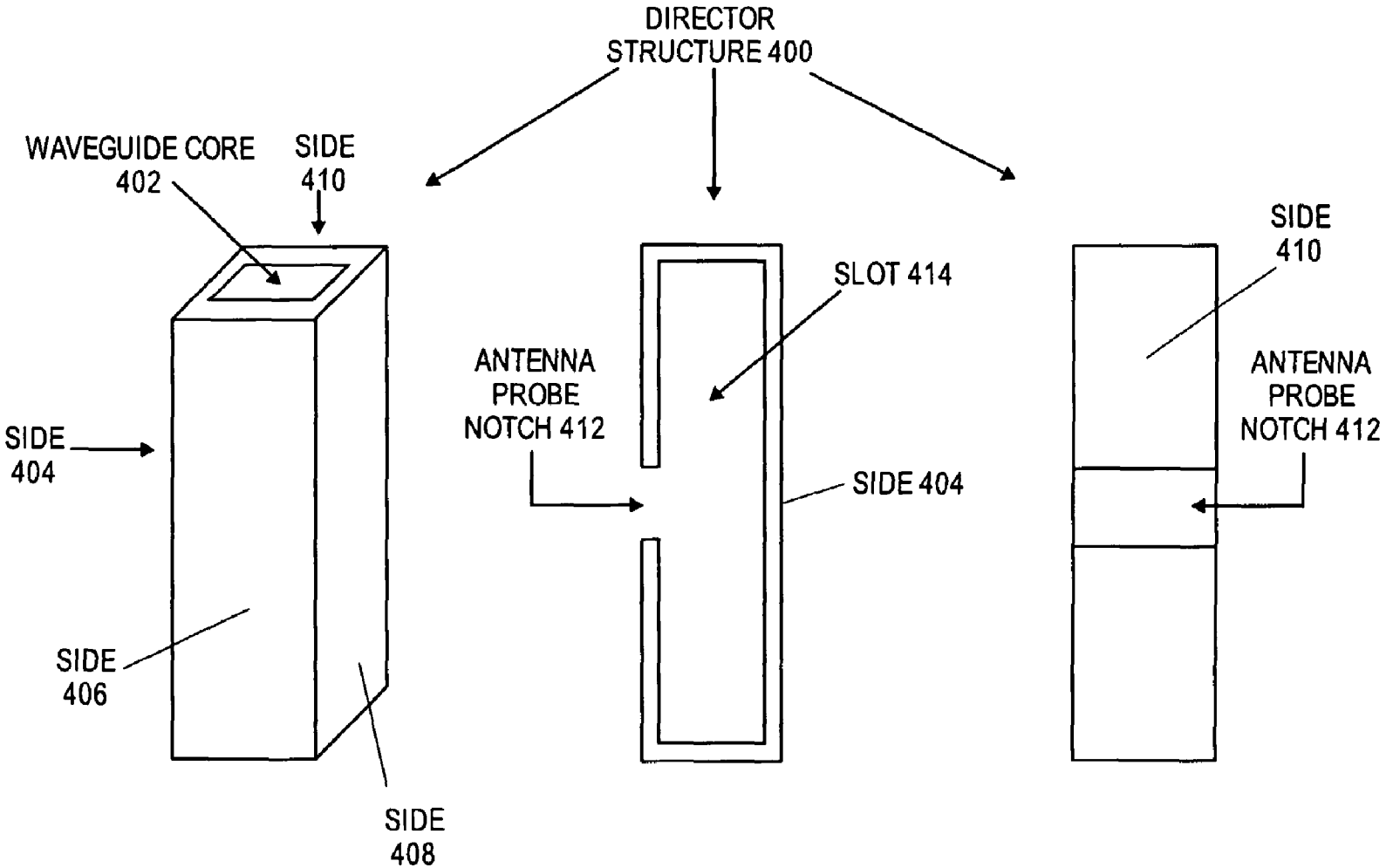
FIG. 4A illustrates a perspective view of a director structure in accordance with one embodiment.
FIG. 4B illustrates a first side view of a director structure in accordance with one embodiment.
FIG. 4C illustrates a second side view of a director structure in accordance with one embodiment.

FIG. 4A illustrates a perspective view for a director structure in accordance with one embodiment. FIG. 4A illustrates a director structure 400. Director structure 400 may have an approximately rectangular shape with four sides 404, 406, 408 and 410. FIG. 4A illustrates a first and second sides 406 and 408, respectively. A third side 404 may be hidden from view in FIG. 4A, but is shown in detail in FIG. 4B. A fourth side 410 may be formed as an integral part of director structure 400, or alternatively, a portion of fourth side 410 may be formed by a surface of PCB 210 when director structure 400 is attached to PCB 210. In one embodiment, the four sides may form a waveguide core 402. Waveguide core 402 may be used to guide an electromagnetic wave for the excitation of a slot in side 404 of director structure 400.

FIG. 4B illustrates a first side view for a director structure in accordance with one embodiment. FIG. 4B illustrates a view of side 404 for director structure 400. As shown in FIG. 4B, director structure 400 may comprise a reverse C structure having an antenna probe notch 412 formed into one side. Antenna probe notch 412 may have a shape and size to receive outer side 310 of antenna probe 300. When assembled, antenna probe 300 may be inserted through antenna probe notch 412 to position antenna probe 300 within waveguide core 402.

FIG. 4C illustrates a second side view of a director structure in accordance with one embodiment. FIG. 4C illustrates a view of side 410 for director structure 400. FIG. 4C provides another view of antenna probe notch 412. Although antenna probe notch 412 is shown in FIGS. 4B and 4C as a rectangular notch formed entirely through side 410, it may be appreciated that antenna probe notch 412 may be formed in other shapes in accordance with a given implementation. For example, antenna probe notch 412 may be formed as a circle, square, triangle, ellipse, or any other shape to accommodate antenna probe 300. The particular size and shape of antenna probe notch 412 may be dependent upon various waveguide characteristics desired for a given implementation of an integrated slot antenna.

In one embodiment, antenna probe 300 and director structure 400 may be combined to form a slot antenna for use with a transceiver, such as transceiver 202. The slot antenna may be fastened to, or integrated with, wireless network card 200. A wireless network card with an integrated slot antenna may be described in more detail with reference to FIGS. 5A–E.

Figure 5E:
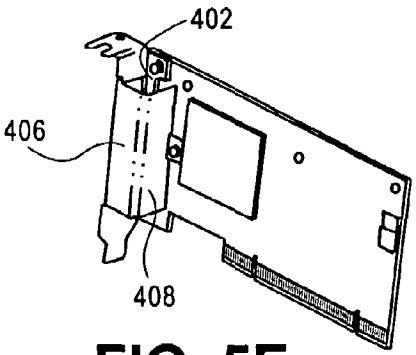
FIG. 5E illustrates a perspective view of a wireless network card with a slot antenna in accordance with one embodiment.
Figure 5D:
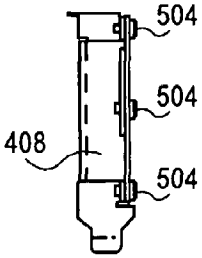
FIG. 5D illustrates a back view in direction D of a wireless network card with a slot antenna in accordance with one embodiment.
Figure 5A:
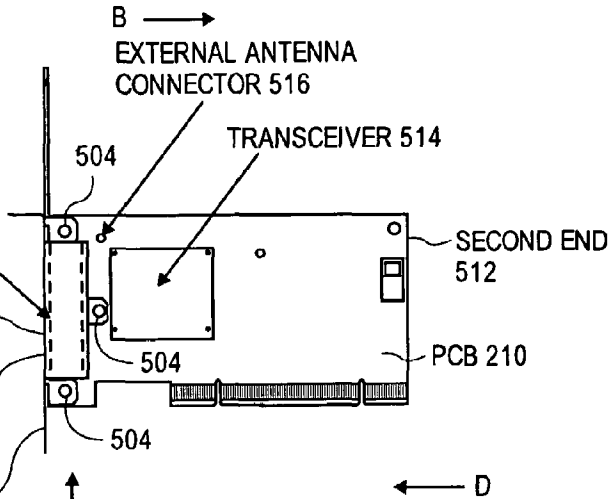
FIG. 5A illustrates a side view of a wireless network cord with a slot antenna in accordance with one embodiment.

FIG. 5A illustrates a side view of a device 500 comprising a wireless network card with a slot antenna in accordance with one embodiment. As shown in FIG. 5A, device 500 may include a slot antenna 502 mounted to PCB 210 having RF transmission line 206. Slot antenna 502 may comprise, for example, director structure 400 mounted to PCB 210 via one or more fastening devices 504. PCB 210 may include transceiver 202, with an optional transceiver shield 514 to cover transceiver 202. PCB 210 may further include an external antenna connector 516 for use with a conventional external antenna.

Figure 5C:
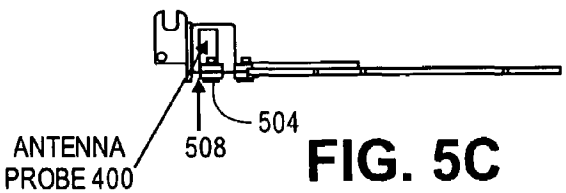
FIG. 5C illustrates a bottom view in direction C of a wireless network card with a slot antenna in accordance with one embodiment.
Figure 5B:
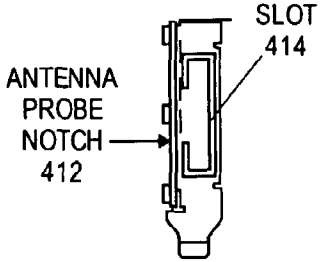
FIG. 5B illustrates a front view in direction B of a wireless network card with a slot antenna in accordance with one embodiment.

FIG. 5B illustrates a front view in direction B of device 500 in accordance with one embodiment. As shown in FIG. 5B, director structure 400 may comprise a rectangular structure to form a slot 414 having antenna probe notch 412. Director structure 400 may couple to PCB 210 by either attaching director structure 400 to PCB 210, or forming director structure 400 as an integral part of a PCI bracket 506 that fits on first end 510 of PCB 210. PCI bracket 506 maybe used to connect device 500 to the housing or chassis of node 102, for example. The embodiments are not limited in this context.

FIG. 5C illustrates a bottom view in direction C of device 500 in accordance with one embodiment. As shown in FIG. 5C, antenna probe 400 may be connected to PCB 210 using a fastening device 508. Examples for fastening device 508 may include a screw, nail, rivet and so forth. Fastening device 508 may be inserted through fastening hole 208 of PCB 210 and into fastening hole 304 of antenna probe 400. Antenna probe 400 may be appropriately positioned within director structure 400 through antenna probe notch 412.

FIG. 5D illustrates a back view in direction D of device 500 in accordance with one embodiment. FIG. 5D illustrates side 408 of director structure 400, as well as fastening devices 406 used to mount director structure 400 to PCB 210.

FIG. 5E illustrates a perspective view of device 500 in accordance with one embodiment. FIG. 5E illustrates sides 406 and 408 of director structure 400. As shown in FIG. 5E, director structure 400 may be open on each end, thereby exposing waveguide core 402 to the surrounding environment.

In operation, device 500 may operate as a wireless network card having an integral slot antenna to send and receive electromagnetic waves for transceiver 202. In one embodiment, for example, antenna probe 412 may receive electromagnetic signals from RF transmission line 206, and radiate electromagnetic waves within director structure 400. Director structure 400 may operate as a waveguide for the electromagnetic waves, with slot 414 to emit a portion of the electromagnetic waves.

In one embodiment, slot antenna 502 may be tuned to an operating frequency of approximately 2.4 Gigahertz. Further, slot antenna 502 may have an input impedance of approximately 50 ohms. Slot antenna 502 may be positioned within director structure 400 through antenna probe notch 412. In this manner, director structure 400 may help partially isolate antenna probe 412 from interference generated by PCB 210.

In one embodiment, device 500 may comprise an 802.11 wireless network card having a first end 510 and a second end 512. Device 500 maybe inserted into a housing for node 102, with the housing having a card slot to expose first end 510, with slot antenna 402 to be connected to first end 510. The position of slot antenna 502 may be arranged such that slot 414 may emit a portion of the electromagnetic waves radiated by antenna probe 412 outside of the housing for node 102. In this manner, slot antenna 502 may propagate the electromagnetic waves to node 104, and receiver electromagnetic waves transmitted by node 104.

In summary, some embodiments may be directed to a folded slot antenna integrated with a low profile PCI bracket. The antenna is formed from a slot cut in the PCI bracket, and an antenna probe which is mounted directly onto the PCI radio card, and couples energy from the PCI card radio to the slot. A director structure is used to isolate the antenna probe and slot antenna from the PCI card, and potentially interfering signals. The whole antenna structure is designed to be a highly efficient antenna across the 2.4 GHz band. The input impedance of the antenna structure is designed to be 50 Ohms, which may be implemented by top loading capacitance between the top of the antenna probe and the director structure. The antenna probe may be fed by a 50 Ohm RF microstrip transmission line. The antenna probe may be mounted on the RF microstrip transmission line in such a way as to transfer the RF energy from a "Pseudo TEM" propagation mode to an open probe structure.

The embodiments may provide several advantages. For example, some embodiments may provide a highly efficient internal antenna for the rear location of a desk top PC. By way of contrast, conventional designs use an external antenna such as an elbow antenna, or a low profile antenna mounted directly on the chassis itself. Such designs may require additional connectors and/or cabling. Further, such designs may require open space on the PC chassis itself, or space behind the chassis for an elbow antenna. As form factors for computers continue to reduce in size, a node such as a PC may continue having little or no space at the back of the chassis for any kind of antenna. Some embodiments, however, may be arranged so that they have little or no impact on the PC Chassis at all. Further, some embodiments may include a PCI bracket antenna design that provides a significant cost reduction over existing antenna solutions. The antenna slot and director structure may comprise an extended bracket folded with a inexpensive tool. The antenna probe may comprise a rod of metal with a threaded hole at one end. Since the slot antenna is integrated with the wireless network card, it may replace a much higher cost procured antenna. As a result, the PCI bracket antenna may lead to a significant reduction and cost and complexity for wireless network solutions.

Numerous specific details have been set forth herein to provide a thorough understanding of the embodiments. It will be understood by those skilled in the art, however, that the embodiments may be practiced without these specific details. In other instances, well-known operations, components and circuits have not been described in detail so as not to obscure the embodiments. It can be appreciated that the specific structural and functional details disclosed herein may be representative and do not necessarily limit the scope of the embodiments.

It is worthy to note that any reference to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

All or portions of an embodiment may be implemented using an architecture that may vary in accordance with any number of factors, such as desired computational rate, power levels, heat tolerances, processing cycle budget, input data rates, output data rates, memory resources, data bus speeds and other performance constraints. For example, an embodiment may be implemented using software executed by a processor. In another example, an embodiment may be implemented as dedicated hardware, such as a circuit, an application specific integrated circuit (ASIC), Programmable Logic Device (PLD) or digital signal processor (DSP), and so forth. In yet another example, an embodiment may be implemented by any combination of programmed general-purpose computer components and custom hardware components. The embodiments are not limited in this context.

In the description and claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. The term "coupled", however, may also mean that two or more elements are not in direct contact with each other, but yet still co-operate or interact with each other. The embodiments are not limited in this context.

The invention claimed is:

1. An apparatus, comprising:

a printed circuit board having a radio frequency transmission line;

a slot antenna to couple to said printed circuit board, said slot antenna comprising:

a director structure having a slot and an antenna probe notch; and an antenna probe, said antenna probe to be coupled to said radio frequency transmission line, and positioned within said director structure through said antenna probe notch;

wherein said printed circuit board comprises part of a wireless network card having a first end and a second end, with said wireless network card arranged to be inserted into a housing having a card slot to expose said first end, with said slot antenna to be connected to said first end.

2. The apparatus of claim 1, wherein said antenna probe receives electromagnetic signals from said radio frequency transmission line and radiates electromagnetic waves within said director structure, said director structure to operate as a waveguide for said electromagnetic waves, and said slot to emit a portion of said electromagnetic waves.

3. The apparatus of claim 1, wherein said slot antenna has an operating frequency of approximately 2.4 Gigahertz.

4. The apparatus of claim 1, wherein said slot antenna has an input impedance of approximately 50 ohms.

5. The apparatus of claim 1, wherein said antenna probe is positioned within said director structure through said antenna probe notch to isolate said antenna probe from interference generated by said printed circuit board.

6. The apparatus of claim 1, wherein said printed circuit board comprises part of a wireless network card.

7. The apparatus of claim 1, wherein said printed circuit board comprises part of a wireless network card arranged in accordance with a Peripheral Component Interconnect Specification.

8. The apparatus of claim 1, wherein said first end comprises a Peripheral Component Interconnect bracket, wherein said director structure is formed as an integral part of said Peripheral Component Interconnect bracket.

9. The apparatus of claim 1, wherein said radio frequency transmission line is a microstrip transmission line.

10. The apparatus of claim 1, wherein said radio frequency transmission line is a microstrip transmission line operating at 50 ohms.

11. A system, comprising:

a printed circuit board having a transceiver to couple to a radio frequency transmission line;

a slot antenna to couple to said printed circuit board, said slot antenna comprising:

a director structure having a slot and an antenna probe notch; and an antenna probe, said antenna probe to be coupled to said radio frequency transmission line, and positioned within said director structure through said antenna probe notch;

wherein said printed circuit board comprises part of a wireless network card having a first end and a second end, with said wireless network card arranged to be inserted into a housing having a card slot to expose said first end, with said slot antenna to be connected to said first end.

12. The system of claim 11, wherein said antenna probe receives electromagnetic signals from said radio frequency transmission line and radiates electromagnetic waves within said director structure, said director structure to operate as a waveguide for said electromagnetic waves, and said slot to emit a portion of said electromagnetic waves.

13. The system of claim 11, wherein said antenna probe is positioned within said director structure through said antenna probe notch to isolate said antenna probe from interference generated by said printed circuit board.

14. The system of claim 11, wherein said printed circuit board comprises part of a wireless network card.

15. The system of claim 11, wherein said printed circuit board comprises part of a wireless network card arranged in accordance with a Peripheral Component Interconnect Specification.

16. The system of claim 11, wherein said first end comprises a Peripheral Component Interconnect bracket, wherein said director structure is formed as an integral part of said Peripheral Component Interconnect bracket.

17. A system, comprising:

a processing system;

a wireless network card to communicate with said processing system, said wireless network card having a transceiver and radio frequency transmission line;

a slot antenna to couple to said wireless network card, said slot antenna comprising:

a director structure having a slot and an antenna probe notch; and an antenna probe, said antenna probe to be coupled to said radio frequency transmission line, and positioned within said director structure through said antenna probe notch.

18. The system of claim 17, wherein said antenna probe receives electromagnetic signals from said radio frequency transmission line and radiates electromagnetic waves within said director structure, said director structure to operate as a waveguide for said electromagnetic waves, and said slot to emit a portion of said electromagnetic waves.

19. The system of claim 17, wherein said antenna probe is positioned within said director structure through said antenna probe notch to isolate said antenna probe from interference generated by said wireless network card.

20. The system of claim 17, wherein said wireless network card is arranged in accordance with a Peripheral Component Interconnect Specification.

21. The system of claim 17, wherein said wireless network card includes a first end and a second end, with said wireless network card arranged to be inserted into a housing having a card slot to expose said first end, with said slot antenna to be connected to said first end.

22. The system of claim 17, wherein said wireless network card includes a first end and a second end, with said first end comprising a Peripheral Component Interconnect bracket, wherein said director structure is formed as an integral part of said Peripheral Component Interconnect bracket.

23. An apparatus, comprising:

a printed circuit board having a radio frequency transmission line;

a slot antenna to couple to said printed circuit board, said slot antenna comprising:

a director structure having a slot aligned in a first direction and an antenna probe notch aligned in a second direction different from the first direction; and an antenna probe, said antenna probe to be coupled to said radio frequency transmission line, and positioned within said director structure through said antenna probe notch.

24. The apparatus of claim 23, wherein the first and second directions are substantially orthogonal to each other.

* * * * *